United States Patent [19]

Herzog

[11] 4,084,285

[45] Apr. 18, 1978

[54] STREET SWEEPER WITH MULTI-POSITION GUTTER BRUSH

[75] Inventor: Fritz W. Herzog, Cedarburg, Wis.

[73] Assignee: Central Engineering Co., Inc., Milwaukee, Wis.

[21] Appl. No.: 788,142

[22] Filed: Apr. 18, 1977

[51] Int. Cl.[2] ..... E01H 1/04

[52] U.S. Cl. ..... 15/87

[58] Field of Search ..... 15/83–87, 15/340

[56] References Cited

U.S. PATENT DOCUMENTS

| | | | |
|---|---|---|---|
| 1,452,307 | 4/1923 | Martin | 15/87 |
| 2,960,708 | 11/1960 | Dear et al. | 15/87 |
| 3,242,521 | 3/1966 | Young | 15/87 |

*Primary Examiner*—Edward L. Roberts

*Attorney, Agent, or Firm*—Andrus, Sceales, Starke & Sawall

[57] ABSTRACT

A street sweeper gutter brush is movable by a ram between an upper inboard retracted position, and a lowered operating position. A suitable linkage connected to the brush permits vertical movement, and a tie rod connecting the sweeper vehicle frame with the brush assembly permits horizontal swinging movement about a fixed vertical axis on the vehicle. By varying the length of the tie rod, and thus the length or radius of the horizontal component of swing, the brush can be moved from a retracted position to a number of different lateral and vertical positions relative to the vehicle and street.

12 Claims, 23 Drawing Figures

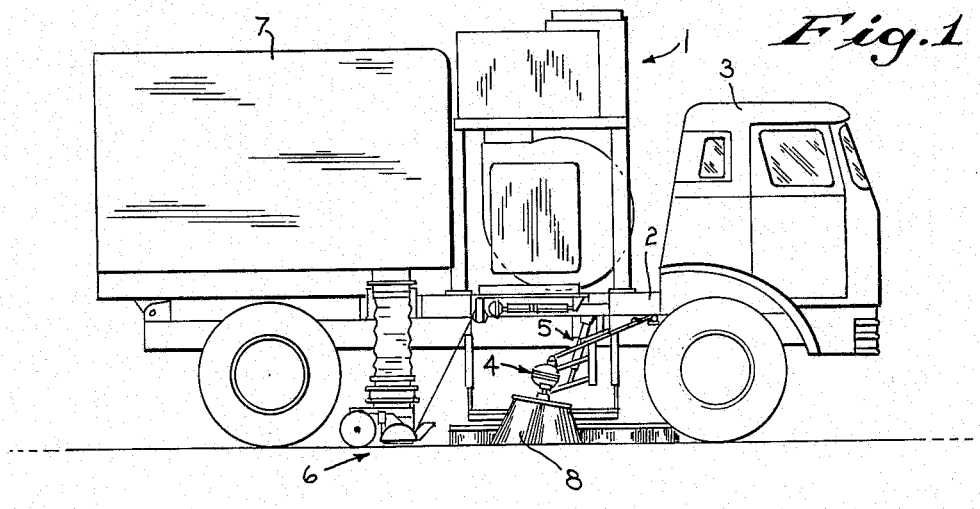
Fig.1
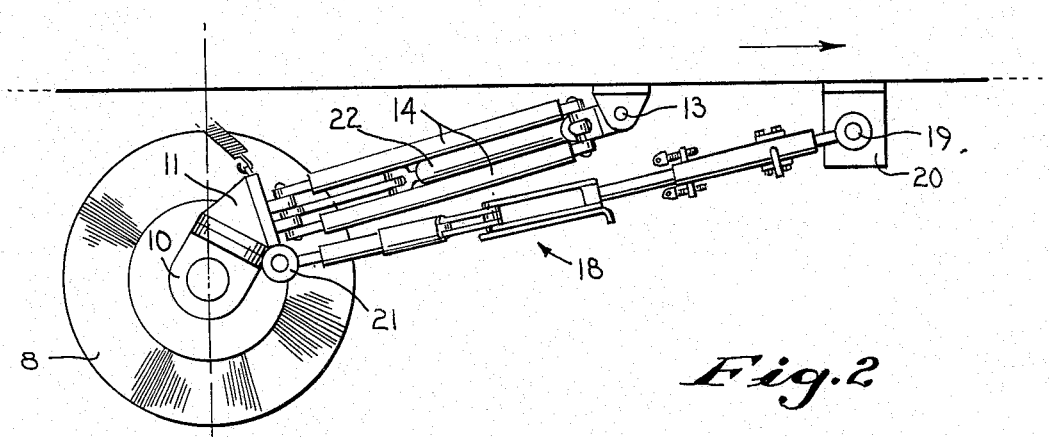
Fig.2
Fig.3
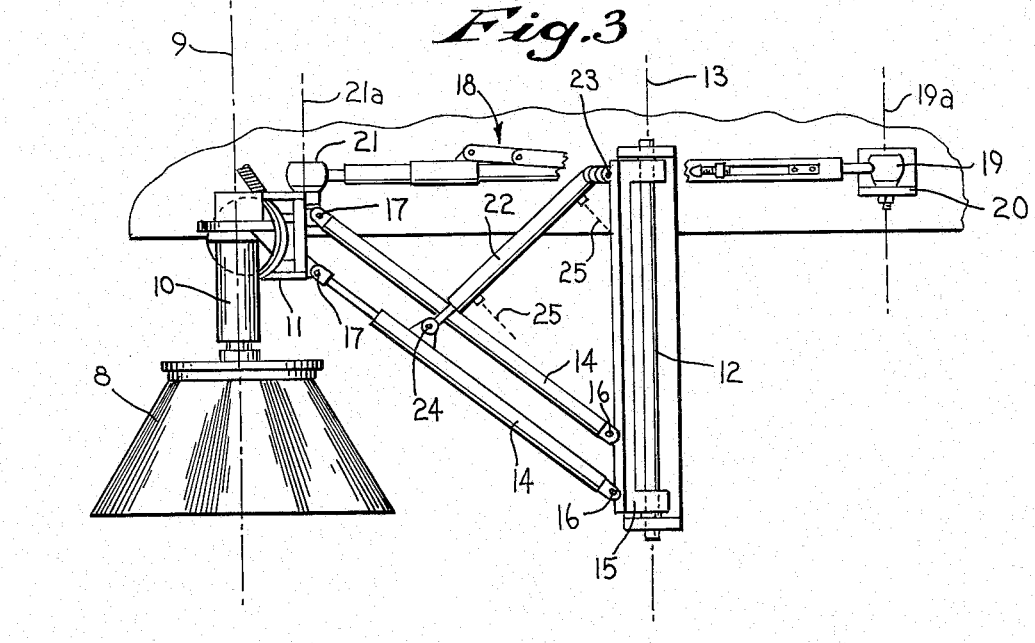

Fig.11
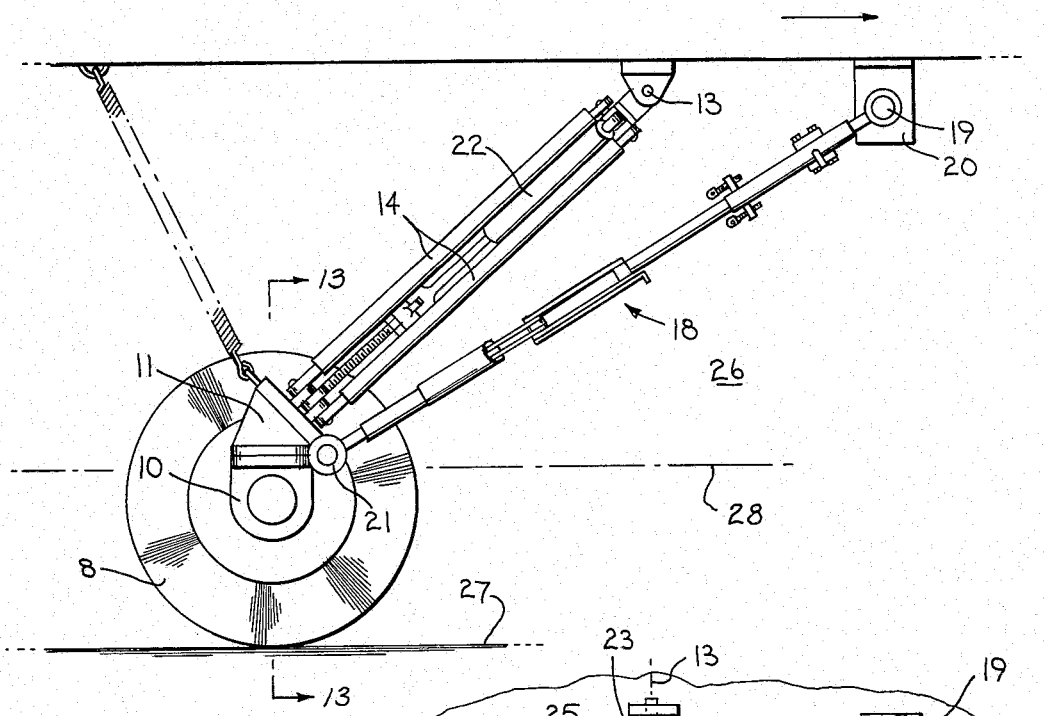
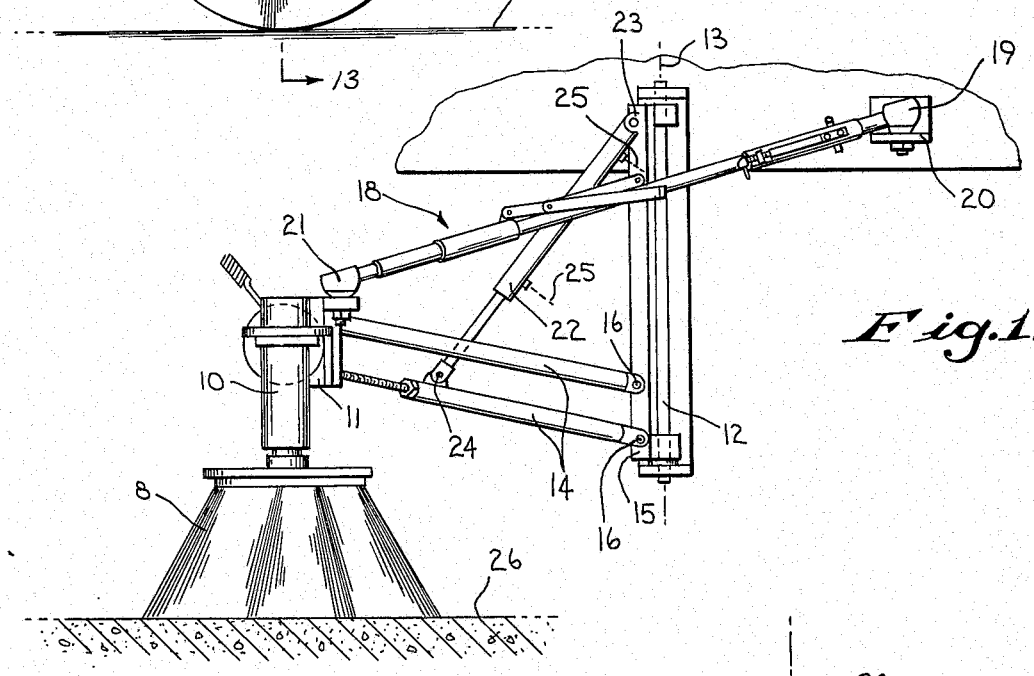
Fig.12
Fig.13
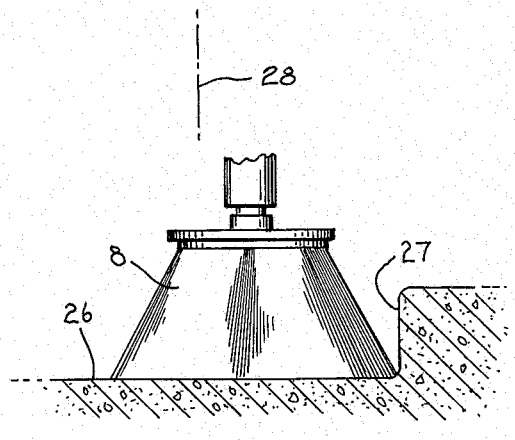

Fig.21
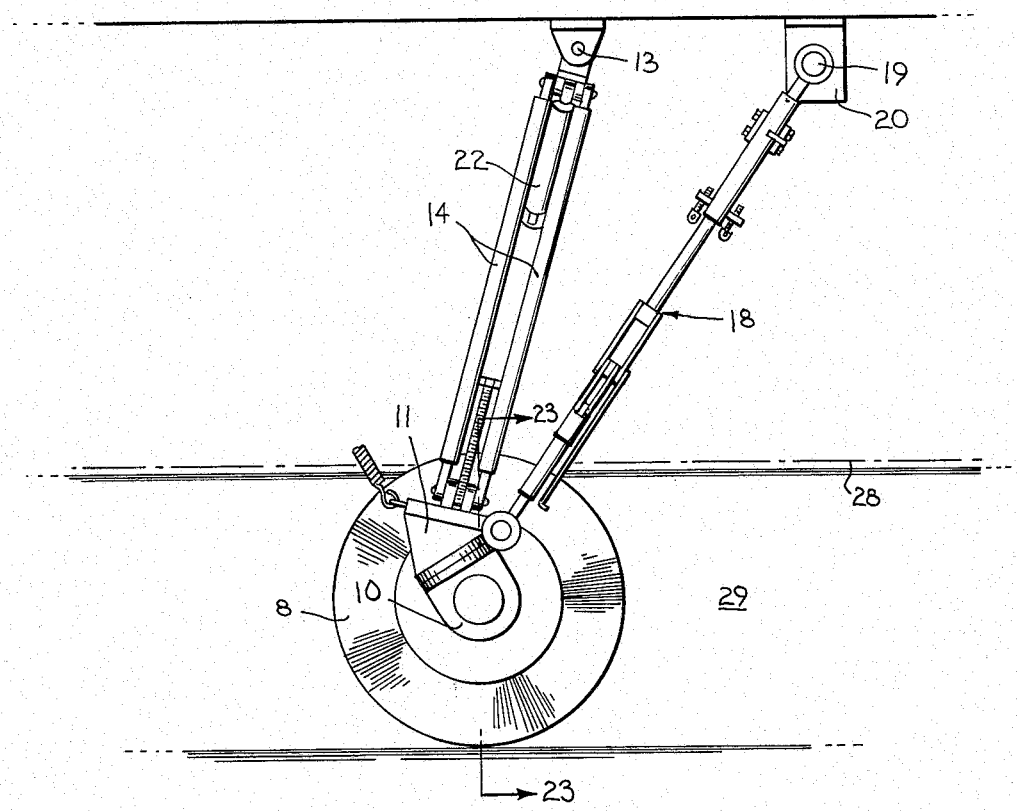
Fig.22
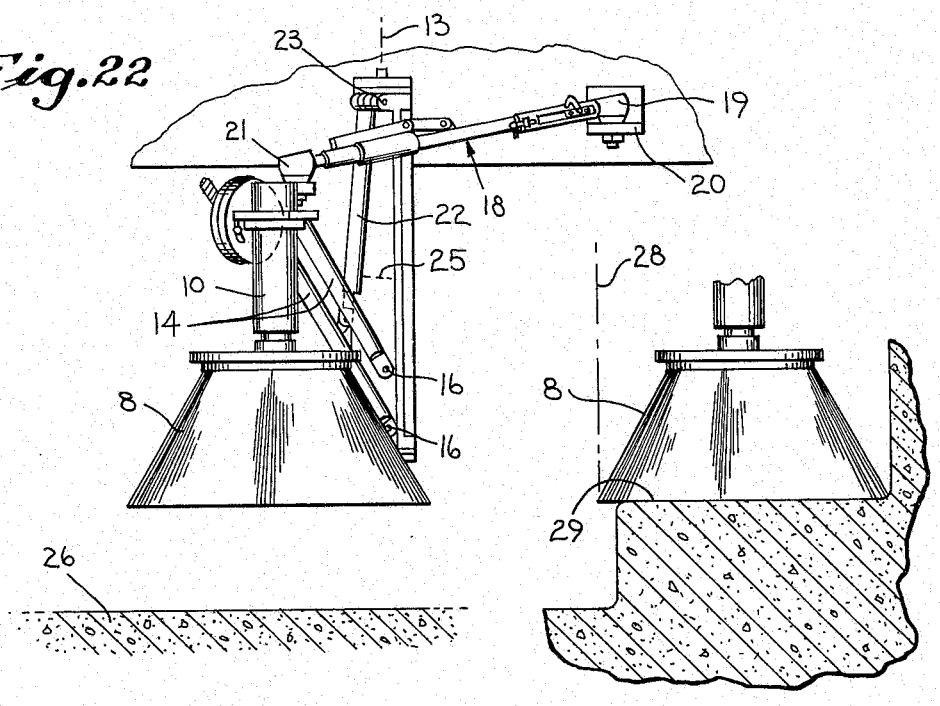
Fig.23

STREET SWEEPER WITH MULTI-POSITION GUTTER BRUSH

PRIOR ART OF INTEREST

U.S. Pat. No. 1,407,180 Todd Feb. 21, 1922; U.S. Pat. No. 1,452,307 Martin April 17, 1923; U.S. Pat. No. 2,960,708 Dear etal November 22, 1960; U.S. Pat. No. 3,242,521 Young March 29, 1966;

BACKGROUND AND SUMMARY OF THE INVENTION

This invention relates to a street sweeper with a multi-position gutter brush.

Street sweepers have long been utilized to remove debris from the surface of a street and adjacent curbs, gutters and the like. The sweepers have usually included a so-called gutter brush mounted for driven rotation about a generally vertical axis, with the brush being movable between a retracted position inboard of the supporting vehicle and an operating position in contact with the street surface.

In previous devices, the gutter brush has been mounted to a linkage arrangement which permitted vertical brush movement about one or more horizontal axes, and a unitary tie rod connecting the vehicle frame and the brush assembly held the brush assembly for suitable horizontal swinging movement about a generally vertical axis. A motive device, such as an hydraulic ram, moved the brush between positions.

Heretofore, the tie rod was of fixed length and the construction was such that movement of the brush assembly from retracted position to street-engaging position brought the brush into the same operating position every time, which was normally in overlapping relation with the vehicle body for engagement with a curb along which the vehicle moved.

However, it has been found that under certain circumstances, the normal operating position of the brush has not been adequate. For example, in some situations, the street may be very narrow and the vehicle must be driven along very closely to the curb. For the brush to sweep against the curb, it would have to be positioned substantially completely inboard of the vehicle body. This was not possible with the above-mentioned normal fixed relationship of the parts. In other situations, it may be desirable to sweep the top of a ledge or sidewalk, thus necessitating positioning of the brush substantially completely outboard of the vehicle and at a raised position relative to the street. This, also, was not possible with the aforementioned construction.

The present invention is directed to the concept of constructing the brush assembly mounting so that the length of the horizontal component of swing of the vertical brush axis about a fixed vertical axis on the vehicle is variable. By so doing, the retractable brush assembly may be selectively positioned between fully inboard, overlapping inboard-outboard, and fully outboard and raised, when the brush is in operating position.

More specifically, it is contemplated that the change in length of the horizontal component of swing shall be made along the axis of the tie rod, which is generally parallel to but offset laterally from the linkage arrangement for vertical movement, when viewed in plan.

In the embodiment disclosed herein, the tie rod itself is adjustable in length to provide the change in horizontal swing component, and thus provide different desired operating positions of the gutter brush.

Brief Description of the Drawings

The accompanying drawings illustrate the best mode presently contemplated by the inventor for carrying out the invention.

In the drawings:

FIG. 1 is a side elevation of a vehicular street sweeper incorporating the multi-position gutter brush of the invention;

FIG. 2 is an enlarged fragmentary top plan view of the gutter brush assembly and mounting therefor, in the normal raised retracted position;

FIG. 3 is an enlarged side elevation of the device as positioned in FIG. 2;

FIG. 11 is an enlarged fragmentary top plan view of the brush positioned as in FIG. 10;

FIG. 13 is a transverse section of the brush, street and curb, taken on line 13—13 of FIG. 11;

FIG. 19 is a schematic view similar to FIG. 14 and showing the gutter brush in outboard raised operating position;

FIG. 21 is an enlarged fragmentary top plan view of the brush positioned as in FIG. 19;

FIG. 22 is an enlarged side elevation of the device as positioned in FIG. 21; and FIG. 23 is a transverse section of the brush, street and raised ledge, taken on line 23—23 of FIG. 21.

DESCRIPTION OF THE PREFERRED EMBODIMENT

Figure 4:
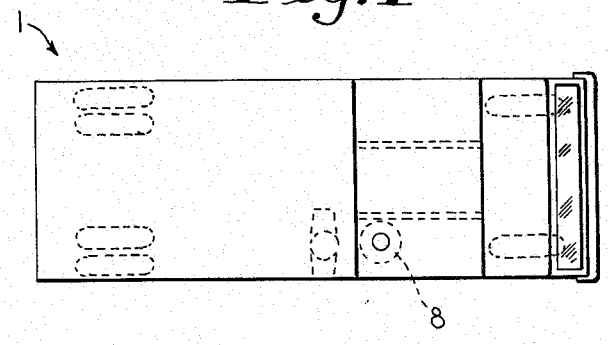
FIG. 4 is a schematic top plan view of the sweeper with the gutter brush in its raised retracted position of FIGS. 2 and 3.

As shown in FIG. 1 of the drawings, the concept of the invention is adapted to be embodied in a vehicular street sweeper 1 having a frame 2, an operator's cab 3, a sweeping assembly 4 and mounting 5, a litter suction pick-up device 6 and a debris storage container 7.

Sweeping assembly 4 and mounting 5 are shown in FIG. 1 in a fully lowered operating position to sweep material into pick-up device 6 for transfer to and storage in container 7; and are shown in FIGS. 2 and 3 in their raised retracted position.

As best shown in the latter two drawing figures, assembly 4 comprises a rotary so-called gutter brush 8 which is rotatably driven about a generally vertical axis 9 by any suitable well-known means, not shown. A drive housing 10 extends upwardly from brush 8, and has a bracket 11 disposed at its upper end.

A vertical shaft 12 defining an axis 13 is suitably fixedly mounted to frame 2 forwardly of assembly 4. Dual pairs of vertically spaced parallel connector rods 14 are connected to a shaft swivel 15 at their forward ends, as on horizontal pivot axes 16, and extend rearwardly for connection to bracket 11, as on horizontal pivot axes 17. Rods 14 and their pivotal end connections provide a linkage means mounting brush 8 for movement together in a vertical direction.

The brush is also mounted for controlled movement in a horizontal or swing direction. For this purpose, a connector means 18 is connected at its forward end to a universal joint 19 having a generally vertical axis 19*a* and mounted on a bracket 20 fixedly secured to frame 2 forwardly of shaft 12. The connector means 18 extends rearwardly past shaft 12 and terminates at its rearward end in a second universal joint 21 having a generally vertical axis 21*a* and mounted on bracket 11.

The elements 12–21 comprise the aforementioned mounting 5.

For purposes of positioning brush 8 between retracted and operative positions, a motive means such as an hydraulic ram 22 is connected at its forward end to swivel 15, as on a horizontal pivot axis 23 disposed above axes 16, and extends rearwardly for connection to a lower connector rod 14, as on horizontal axis 24. Ram 22 may be actuated through hydraulic lines 25 by any suitable control means, not shown, preferably located in cab 3. Extension and retraction of the ram will cause a compound three-dimensional re-positioning of brush 8, with movement thereof involving both vertical and horizontal directional components as dictated by the interconnections of the elements of mounting 5.

The retracted or travel position of brush 8 and its associated elements, with the brush completely inboard, is not only shown in FIGS. 2 and 3, but is also shown in the schematic top plan view of the vehicle shown in FIG. 4.

Figure 10:
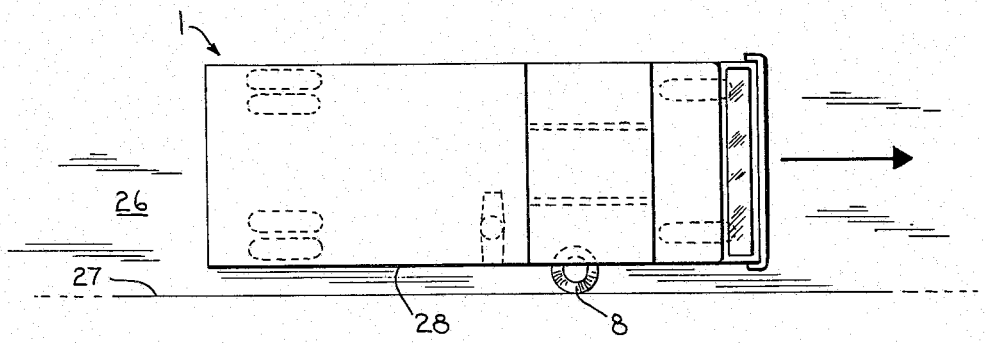
FIG. 10 is a schematic view similar to FIG. 4 and showing the gutter brush in normal lowered operating position and overlapping the vehicle.
Figure 12:
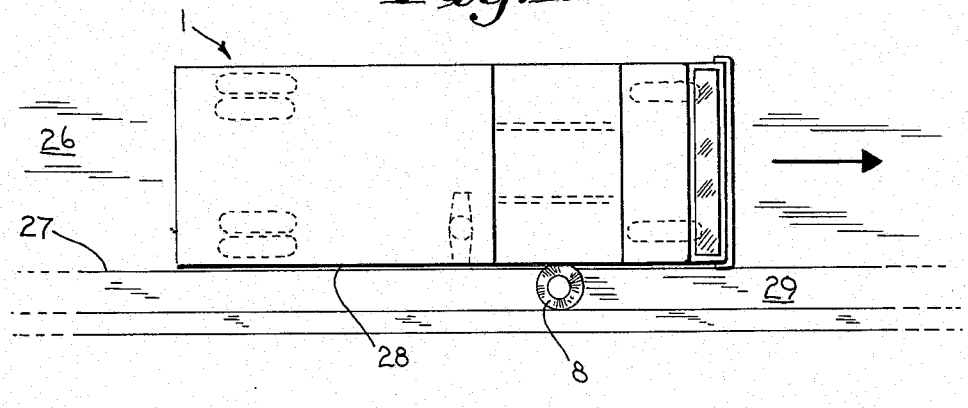
FIG. 12 is an enlarged side elevation of the device as positioned in FIG. 11.
Figures 5, 6, 15, 20:
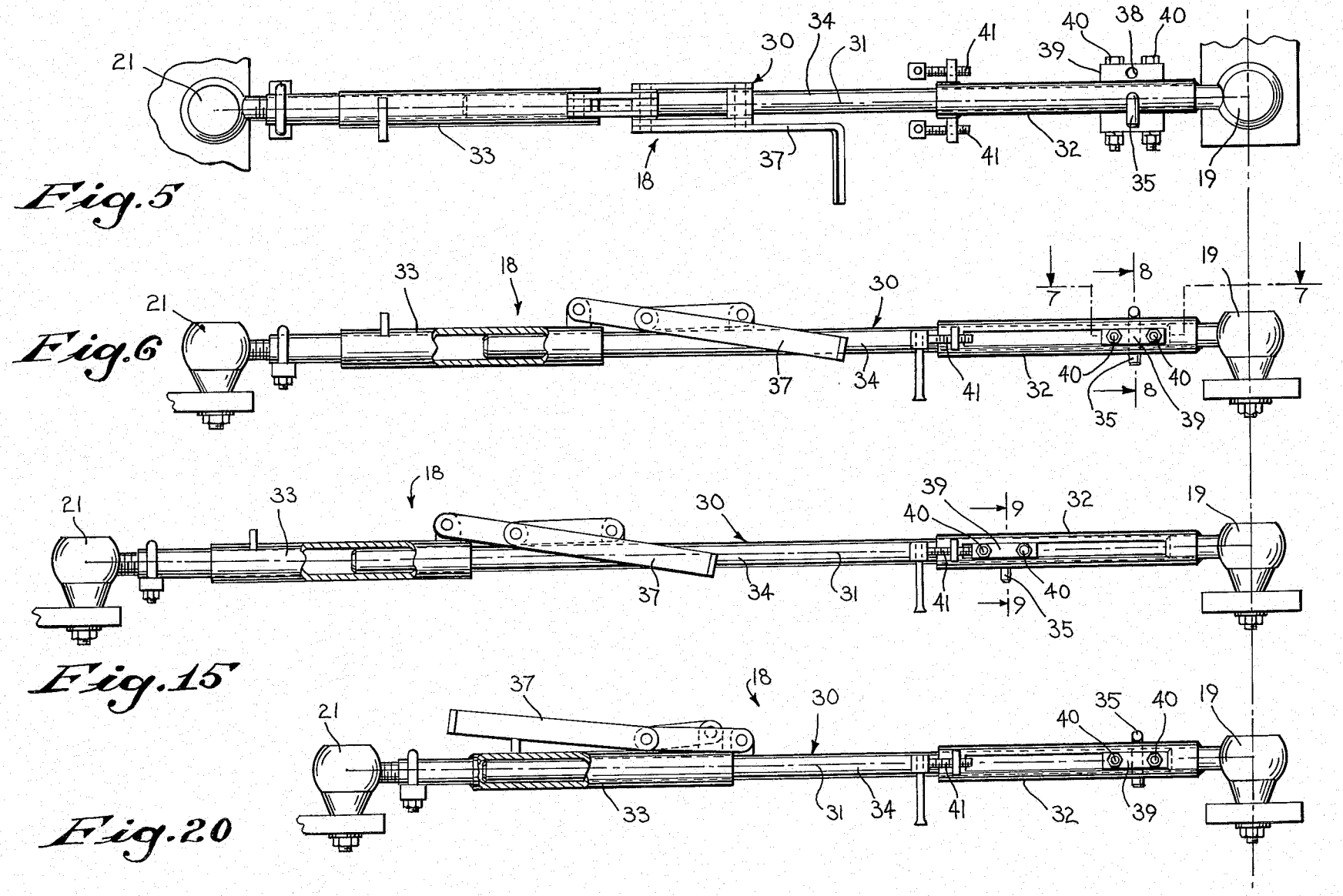
FIG. 5 is an enlarged top plan view of the tie rod, with the setting at intermediate length.
FIG. 6 is a side elevation of the tie rod positioned as in FIG. 5.
FIG. 15 is a side elevation of the tie rod with the locking pin removed and the rod lengthened to provide the position of FIG. 14.
FIG. 20 is a side elevation of the tie rod with lever adjusted to provide the shortened rod and position of FIG. 19.
Figure 7:
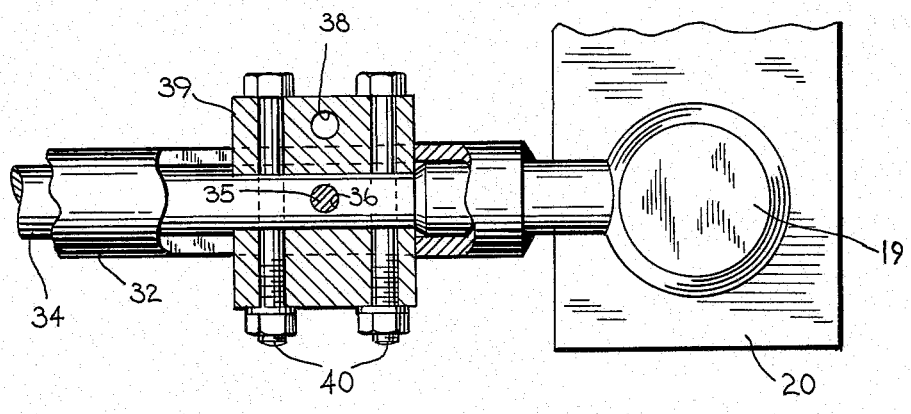
FIG. 7 is an enlarged fragmentary longitudinal axial section of the tie rod, taken on line 7—7 of FIG. 6.
Figure 8:
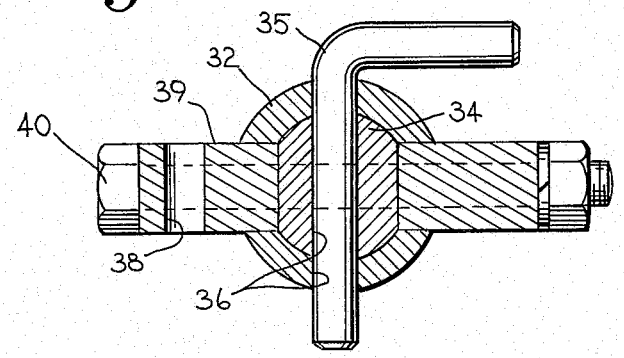
FIG. 8 is an enlarged transverse section of the tie rod, taken on line 8—8 of FIG. 6 and showing the locking pin in place.

During normal operation of sweeper 1, ram 22 is actuated to swing brush 8 outwardly and downwardly from its retracted position until it engages the street surface 26 and, if desired, sweep against a curb 27; with the position of brush 8 being such as to be in overlapped relationship between the vehicle body perimeter 28 and the street. Thus, brush 8 would be partly inboard and partly outboard of perimeter 28 during sweeping operations. This normal lowered position is shown schematically in FIG. 10, wherein the perimeter 28 of sweeper 1 is spaced inwardly from curb 27. This is possible when a wide street is being swept. FIGS. 11–13 illustrate the parts in detail when the brush is so lowered. It is to be noted that connector means 18 retains the same length, and thus the radius of horizontal swing component remains the same in shifting from the retracted position of FIGS. 2–4 to the lowered position of FIGS. 10–13.

It has been found that in some instances the normal sweeping position of brush 8 may not be suitable, such as when sweeper 1 is to travel along a very narrow street and sweep a curb. In such a situation, and for maximum sweeping efficiency, when brush 8 is in its lowered operating position, it should be positioned substantially completely inboard of the vehicle perimeter 28, as shown schematically in FIG. 14, with the perimeter 28 and curb line 27 substantially coinciding.

In other instances, it has been found that it is sometimes desirable to sweep a horizontal ledge 29, which extends along the side of the street, especially on bridges, with the ledge being raised from the level of the street. In this case, brush 8 must sweep completely outboard of the sweeper perimeter 28, as schematically shown in FIG. 19. Furthermore, the brush must be able to sweep efficiently at a higher level than the street.

It has been discovered that the above variations from the normal brush operating position can be accomplished by constructing the connecting means 18 so that it is selectively variable in length along its axis to thereby vary the radius of horizontal swing component. For this purpose, and referring first to FIGS. 5–8, means 18 comprises an elongated tie rod element 30 having a longitudinal axis 31 having a length corresponding to the radius of horizontal swing component.

Element 30 is adapted to be of fixed length during extension and retraction of brush 8, and during the sweeping operation, but is adapted to be selectively adjustable (along with the said radius) to change the swing geometry to accomplish the desired multi-purposing of the operating brush.

For this purpose, and in the present embodiment, element 30 comprises a tri-part assembly including a forward sleeve 32 connected at its front end to universal joint 19, a rearward sleeve 33 connected at its rear end to universal joint 21, and a central shaft 34. The ends of shaft 34 are telescopingly received within sleeves 32 and 33 and joins them to create the complete element 30.

The forward end of shaft 34 normally extends within sleeve 32 to adjacent joint 19, and a releasable locking pin 35 extends through aligned openings 36 in the members to hold them in fixed relationship. See FIG. 8. The rearward end of shaft 34 normally extends within sleeve 33 to a position substantially spaced from joint 21. A suitable lever mechanism 37 joins shaft 34 to sleeve 33.

The showing of the tie rod element of FIGS. 5–8 is the same as that shown in FIGS. 2, 3 and 11, 12. The fixed positional length of the connector is such that upon extension of ram 22, brush 8 will overlap the vehicle, as also shown in FIG. 4.

Figure 14:
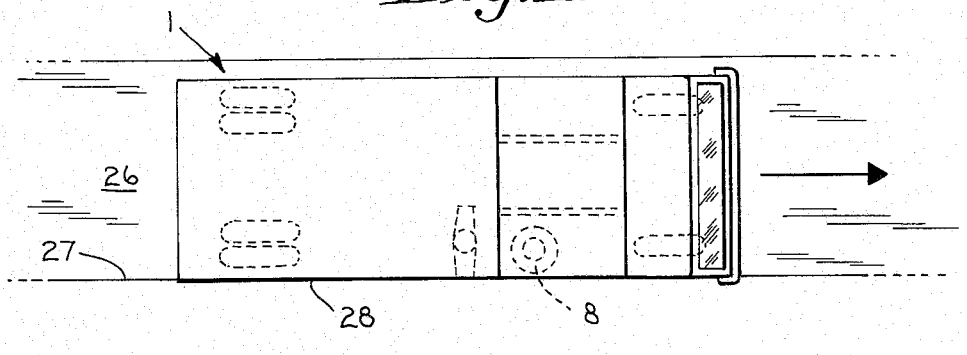
FIG. 14 is a schematic view similar to FIG. 10 and showing the gutter brush in inboard operating position.
Figure 9:
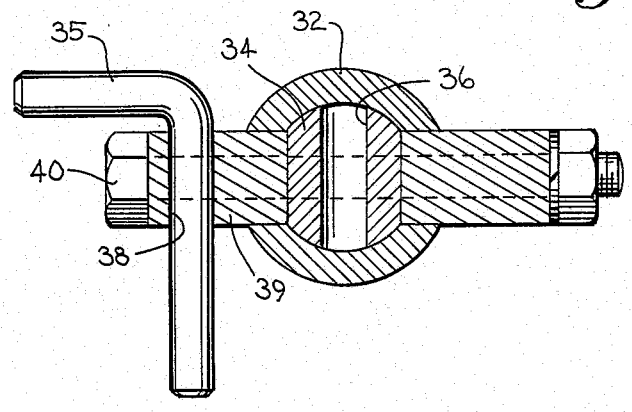
FIG. 9 is a view similar to FIG. 8, taken on line 9—9 of FIG. 15 and showing the locking pin removed.
Figure 16:
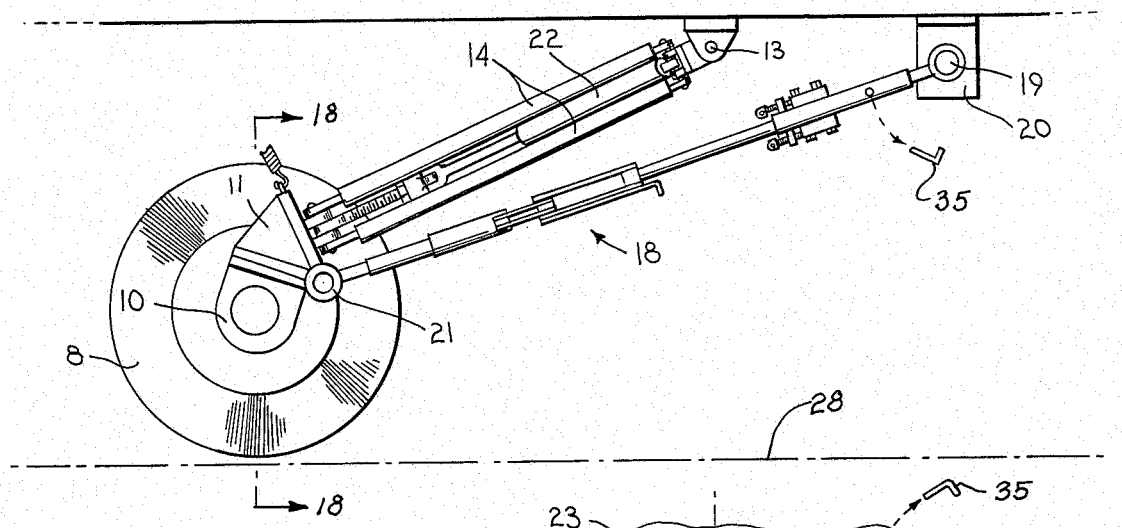
FIG. 16 is an enlarged fragmentary top plan view of the brush positioned as in FIG. 14.
Figure 17:
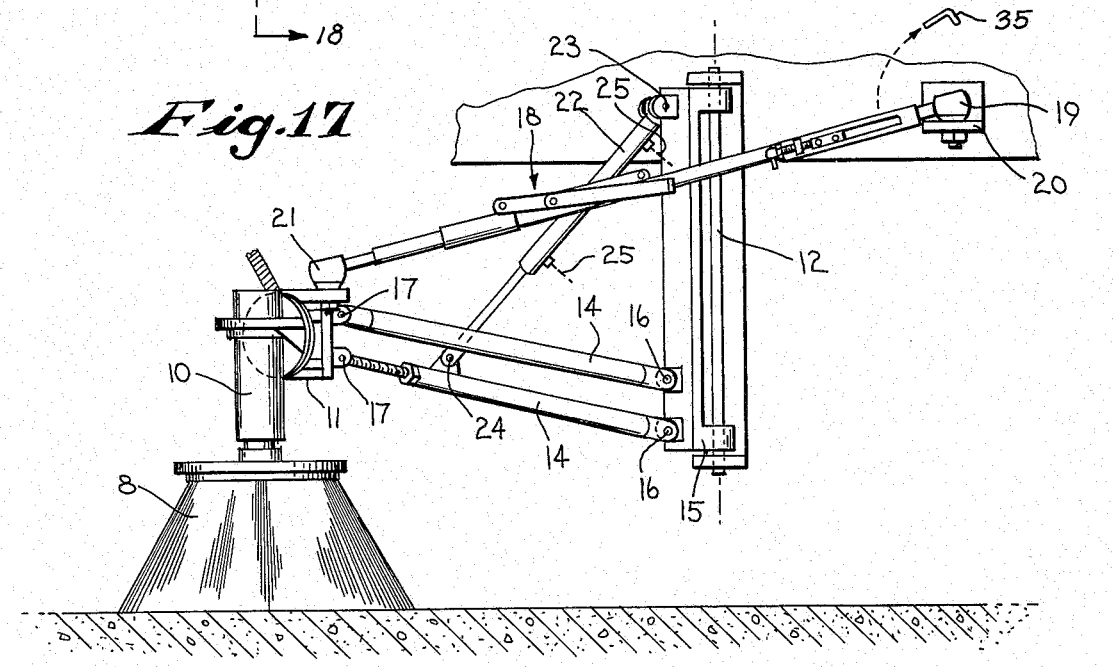
FIG. 17 is an enlarged side elevation of the device as positioned in FIG. 16.
Figure 18:
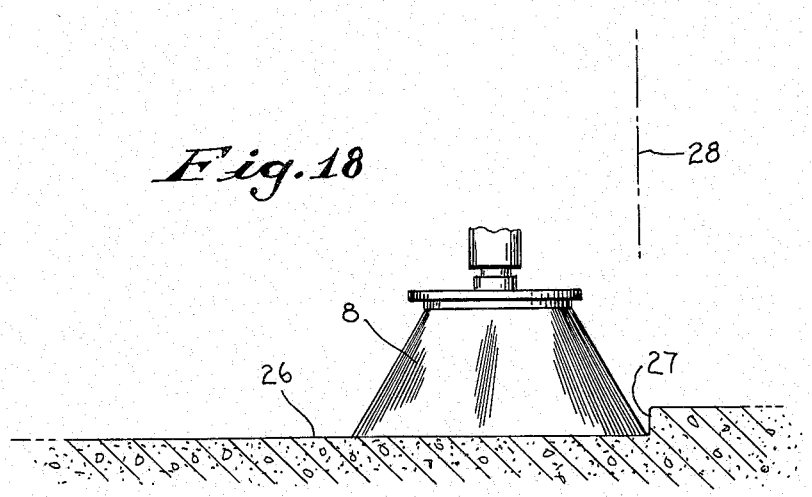
FIG. 18 is a transverse section of the brush, street and curb, taken on line 18—18 of FIG. 16.

As previously pointed out, it is sometimes desirable to move brush 8 to an operating position wholly inboard of the vehicle, as shown in FIG. 14. Referring to FIGS. 15–18, this is accomplished by lengthening axis 31 (and the said radius) from the normal. Pin 35 is removed from openings 36 and placed in a retaining opening 38 in a bracket 39 slidable on sleeve 32. See FIG. 9. When ram 22 is actuated, shaft 34 will telescope outwardly until bolts 40 on shaft 34 and bracket 39 engages adjustable stop screws 41 on sleeve 32. With continued movement of ram 22, element 30, which now has an effectively fixed length providing a longer axis 31, will permit swinging compound drop-down movement of brush 8 to the inboard operating position shown in FIGS. 14 and 18.

Furthermore, and as previously pointed out, it is also sometimes desirable to move brush 8 to an operating position wholly outboard of sweeper 1 and raised from the normal street level, as partially shown in FIG. 19. Referring to FIGS. 20–23, this is accomplished by shortening axis 31 and the said radius) from the normal. Lever 37 is actuated to further telescope shaft 34 into rear sleeve 33. Actuation of ram 22 will cause element 30, which now has a fixed length providing a shorter axis 31, to swing compoundly so that brush 8 stays high and becomes operatively disposed substantally completely outboard of the vehicle. The geometry is such that when brush 8 is at its laterally outermost position, it is also disposed above street level and adapted to sweep a raised ledge 29, as shown in FIG. 23.

It should be noted here that axis 31 extends rearwardly from forwardly of shaft 12, is generally parallel and co-extensive with members 14 and 22 in all positions, and terminates adjacent brush 8, when viewed in plan.

By selectively varying the length of the effective radius of horizontal swing component, the gutter brush 8 may be swung from a retracted raised inboard position to a multiplicity of operating positions, both outboard and inboard of the vehicle and also at vertical levels other than street level.

Various modes of carrying out the invention are contemplated as being within the scope of the following claims particularly pointing out and distinctly claiming the subject matter which is regarded as the invention.

I claim:

1. In a vehicular street sweeper;

a. a frame, b. a gutter brush rotatable on a first generally vertical axis for sweeping debris from the street, c. linkage means mounted at its forward end for rotation about a second vertical axis and extending rearwardly to a connection with said brush, said linkage means and brush being pivotable together in a vertical direction, d. connector means mounted at its forward end to said frame and forwardly of said linkage means, with said connector means extending rearwardly to a connection with said brush, e. said connector means defining a longitudinal axis, the length of which corresponds to the radius of horizontal swing component of said brush, and with said longitudinal axis extending generally parallel to said linkage means, f. motive means connected between said frame and said linkage means for causing said brush to swing compoundly with said linkage means and said connector means from a retracted position inboard of the vehicle perimeter and out of engagement with the street to an operating position, g. and means for selectively adjusting the length of said radius of horizontal swing component of said brush so that said brush is movable by said motive means to selected operating positions including: overlapping said vehicle perimeter, substantially inboard or outboard of the said perimeter, and at or above street level.

2. The vehicular street sweeper of claim 1 wherein said radius length adjusting means comprises means to adjust the length of said connector means.

3. The vehicular street sweeper of claim 2:

a. wherein with a first adjusted length of said connector means, compound swinging of said brush to operating position brings the latter into overlapping relationship with said vehicle perimeter and into engagement with the street, b. and wherein with a second adjusted length of said connector means, longer than said first length, compound swinging of said brush to operating position brings the latter to substantially inboard of the said vehicle perimeter and into engagement with the street.

4. The vehicular street sweeper of claim 3:

a. which includes means to lock said connector means at said first length, b. and wherein said motive means, when actuated, serves as means to lengthen said connector means from said first length to said second length when said locking means is released.

5. The vehicular street sweeper of claim 4 which includes stop means to limit the lengthening of said connector means by said motive means.

6. The vehicular street sweeper of claim 4 wherein said connector means includes:

a. a pair of end sleeves and a shaft extending between said sleeves and telescoping therewith, b. and a releasable pin normally extending through one of said sleeves and said shaft and forming said locking means.

7. The vehicular street sweeper of claim 4 wherein said connector means includes:

a. a pair of end sleeves and a shaft extending between said sleeves and telescoping therewith, b. a releasable pin normally extending through one of said sleeves and said shaft and forming said locking means, c. and lever means connecting the other of said sleeves and said shaft, and with said lever means being actuatable to telescope said other of said sleeves and said shaft to shorten said connector means.

8. The vehicular street sweeper of claim 7 which includes stop means to limit the lengthening of said connector means by said motive means.

9. The vehicular street sweeper of claim 2:

a. wherein with a first adjusted length of said connector means, compound swinging of said brush to operating position brings the latter into overlapping relationship with said vehicle perimeter and into engagement with the street, b. and wherein with a second adjusted length of said connector means, shorter than said first length, compound swinging of said brush to operating position brings the latter to substantially outboard of the said vehicle perimeter and disposed above the street level for sweeping ledges disposed along the side of the street.

10. The vehicular street sweeper of claim 9 wherein said connector means includes:

a. a pair of end sleeves and a shaft extending between said sleeves and telescoping therewith, b. and lever means connecting one of said sleeves and said shaft, and with said lever means being actuatable to telescope said one of said sleeves and said shaft to shorten said connector means.

11. The vehicular street sweeper of claim 9 wherein said connector means includes:

a. a pair of end sleeves and a shaft extending between said sleeves and telescoping therewith, b. lever means connecting one of said sleeves and said shaft, and with said lever means being actuatable to telescoping said one of said sleeves and said shaft to shorten said connector means, c. and a releasable pin normally extending through the other of said sleeves and said shaft with release of said pin permitting lengthening of said connector means.

12. The vehicular street sweeper of claim 2:

a. wherein with a first adjusted length of said connector means, compound swinging of said brush to operating position brings the latter into overlapping relationship with said vehicle perimeter and into engagement with the street, b. and wherein said a second adjusted length of said connector means, longer than said first length, compound swinging of said brush to operating position brings the latter to substantially inboard of the said vehicle perimeter and into engagement with the street, c. means to lock said connector means at said first length, d. said motive means, when actuated, serving as means to lengthen said connector means from said first length to said second length when said locking means is released, e. and wherein with a third adjusted length of said connector means, shorter than said first length, compound swinging of said brush to operating position brings the latter to substantially outboard of the said vehicle perimeter and disposed above the street level for sweeping ledges disposed along the side of the street.

* * * * *

UNITED STATES PATENT OFFICE

CERTIFICATE OF CORRECTION

PATENT NO. : 4,084,285

DATED : April 18, 1978

INVENTOR(S) : Fritz W. Herzog

It is certified that error appears in the above-identified patent and that said Letters Patent are hereby corrected as shown below:

Column 7, Line 1, Delete "telescoping" and substitute therefor ---telescope---

Column 7, Line 13, Delete "said" first occurrence and Substitute therefor ---with---

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*